US005139389A

United States Patent [19]

Eng et al.

[11] Patent Number: 5,139,389

[45] Date of Patent: * Aug. 18, 1992

[54] EXPANDABLE BLADE ROOT SEALANT

[75] Inventors: Jesse Eng, Jupiter, Fla.; Ronald L. Sigworth, Manchester, Conn.

[73] Assignee: United Technologies Corporation, Hartford, Conn.

[ * ] Notice: The portion of the term of this patent subsequent to Aug. 11, 2009 has been disclaimed.

[21] Appl. No.: 590,979

[22] Filed: Oct. 1, 1990

Related U.S. Application Data

[63] Continuation-in-part of Ser. No. 584,819, Sep. 14, 1990.

[51] Int. Cl.[5] ..... F01D 5/30

[52] U.S. Cl. ..... 416/248; 416/219 R

[58] Field of Search ..... 416/248, 219 R, 500

[56] References Cited

U.S. PATENT DOCUMENTS

| | | | |
|---|---|---|---|
| 3,807,898 | 4/1974 | Guy et al. | 416/220 |
| 4,175,912 | 11/1979 | Crane et al. | 416/193 A |
| 4,389,161 | 6/1983 | Brumen | 416/220 R |
| 4,444,544 | 4/1984 | Rowley | 416/221 |
| 4,725,200 | 2/1988 | Welhoelter | 416/500 |
| 4,767,247 | 8/1988 | Partington et al. | 415/500 |

FOREIGN PATENT DOCUMENTS

| | | | |
|---|---|---|---|
| 488971 | 12/1952 | Canada | 416/500 |
| 826332 | 12/1951 | Fed. Rep. of Germany | 416/248 |
| 1144925 | 10/1957 | France | 416/500 |

*Primary Examiner*—John T. Kwon

*Attorney, Agent, or Firm*—Herbert W. Mylius

[57] ABSTRACT

A seal is provided for preventing passage of working medium gases between the roots of the rotor blades of a gas turbine engine and the rotor thereof. The seal comprises a compressed laminar exfoliated graphite piece placed in the cavity between the root of the rotor blade and the receiving slot in the rotor disk, which piece expands upon heating to seal said cavity.

7 Claims, 5 Drawing Sheets

EXPANDABLE BLADE ROOT SEALANT

The invention was made under a U.S. Government contract and the Government has rights herein.

CROSS REFERENCE TO RELATED APPLICATION

This is a continuation-in-part of U.S. patent application Ser. No. 584,819, filed Sep. 14, 1990 in the names of Sigworth et al.

TECHNICAL FIELD

The present invention relates to gas turbine engines, and particularly to compressor and turbine disks having blades mounted in the periphery thereof.

BACKGROUND

Gas turbine assemblies commonly comprise a plurality of turbine and compressor blades, each of which is joined to a disk through the engagement of a fir tree or dove tail blade root in a corresponding disk slot and extends radially outward from the periphery of the disk, across the path of working medium gases flowing through the engine. Due to the advent of high performance engines, and particularly in light of the concern for fuel conservation, there has been an increasing desire to avoid air leakages within the engine. Obviously, any leakage constitutes a loss of energy, efficiency, and fuel economy. This invention relates to the sealing of the gap between the blade root of each rotor blade and the slot in which it is mounted in the disk.

In the past, attempts to reduce this source of leakage have included sealant materials such as silicon rubber compositions, which are temperature limited, and epoxy cements. These solutions have had problems of maintainability and blade removal, since removal of such materials or their residues is a labor intensive and difficult process. Other approaches to the reduction of leakage between blade root and disk have included providing sealing means at the disk surface, which also provide means to lock the blade root in position in the disk. An example of such a bladed rotor assembly is shown in U.S. Pat. No. 3,807,898, of Guy et al. In this assembly, a plurality of sealing plates extend from the rotor disk to each rotor blade platform, to lock the blades in place and to block leakage between the platforms and the disk. Another locking device is illustrated in commonly owned U.S. Pat. Nos. 4,389,161 and 4,444,544, of Brumen and Rowley, respectively, which are incorporated herein by reference. According to these references, each rotor blade is retained against fore and aft movement by a lock pin, which also serves to block the leakage of working medium gases through the blade attachment slot across the disk. The present invention is particularly advantageous in conjunction with locking means such as taught by these references.

SUMMARY OF THE INVENTION

It is an object of the present invention to provide a simple, cost effective, and efficient means to provide a seal against leakage between the blade roots and disk of a rotor assembly. It is a further object of this invention to provide a seal which is easily put in place. It is still another object of the invention to provide a means for sealing cavities formed in gas turbine assemblies where loose fitting parts result in the formation of a passageway for working medium gases. Accordingly, it is to be understood that while the present disclosure is presented in terms of the sealing of blade root cavities, the present invention is meant to encompass other similar cavities, such as those formed between a stator and the flowpath outer case of a turbine, the gap between the disk and the underside of the compressor blade platform, or the cavity formed between blade outer air seals (tip shrouds) and the O.D. case, etc.

These and other objects have been achieved by the provision of a laminar graphite sealing means, which is compressed to fit precisely within the cavity between the blade root and the blade attachment slot in the disk, and upon heating to the operating temperature of the turbine or compressor, expands to fill the cavity. In a preferred embodiment, the sealing means is press molded to a specific configuration or chamfered to permit ease of assembly, and is held in its compressed state by the presence of an organic resinous binder which burns off at a slightly elevated temperature.

These and other objects and advantages of the invention will become more readily understood through reference to the following description of the drawings and preferred embodiments.

DETAILED DESCRIPTION OF THE INVENTION

Figure 1:
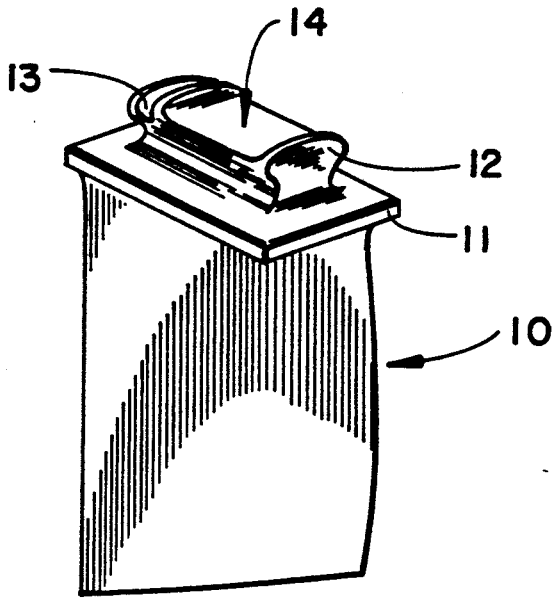
FIG. 1 is a perspective of a compressor rotor blade such as is employed in the present invention.

The concept of the invention is clearly illustrated in the Figures. In FIG. 1, a rotor blade 10 is shown, with platform 11, and blade root 12. As shown in this figure, the blade root may have a groove 13, adapted to accept a lock pin or locking snap ring (not shown) upon assembly, and a seal mounting surface, 14, of such configuration to accept the expandable seal means, illustrated in FIG. 2. The base of the blade root, 12, need not be of a dovetail configuration as illustrated, but may also be of a fir tree or other suitable configuration, or having a smooth inner diameter surface without a specific seal mounting surface or groove for a locking mechanism.

Figure 2:
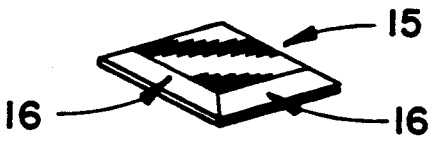
FIG. 2 is a perspective view of a preferred sealing means in accordance with the present invention.

The expandable seal means 15 of this invention is illustrated in FIG. 2, wherein it is shown in a preferred configuration, having chamfered surfaces 16. While the present invention is intended to encompass the use of seals having no chamfers, e.g. flat or rounded seal edges, it has been found to be advantageous to chamfer or bevel at least the leading edge of the seal for ease of insertion into the receiving slot in the disk. The seal is of a laminar graphite material, comprising multiple thin layers of exfoliated graphite. A preferred form of this material is marketed under the trademark GRA- FOIL ® Flexible Graphite, by Union Carbide Corporation. Such material is flexible, compactible, and resilient, and may be easily cut or shaped to the desired configuration. In addition, graphite offers thermal stability up to temperatures in excess of 2000° F., thermal conductivity, and natural lubricity. Other similar graphite sheet or laminar materials, suitable for gasketing or fluid sealing utility, may also be used.

Figure 3:
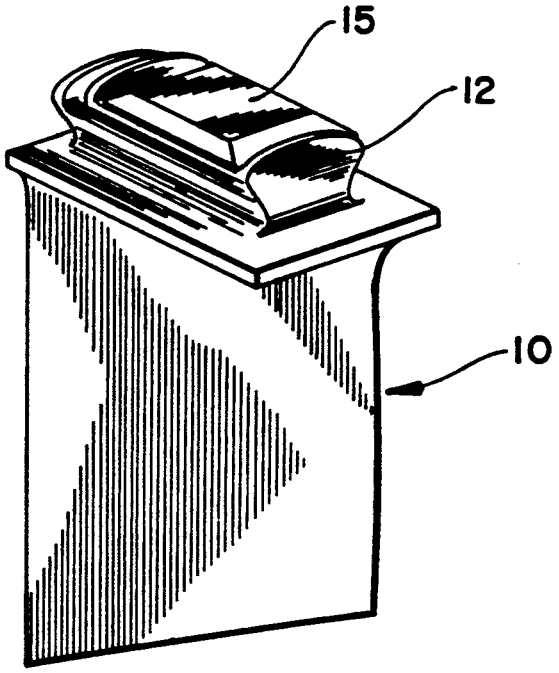
FIG. 3 is a perspective view of a rotor blade and sealing means, showing their relationship.

As illustrated in FIG. 3, the compressed expandable graphite seal material is placed on the seal mounting surface of the blade root 12 for insertion into the blade receiving slot of the disk. For ease of assembly, the graphite seal may be adhesively mounted, such as with double faced tape, Eastman 910 Adhesive (a trademark of Eastman Kodak Company), or like means. In this manner, the rotor blade assembly, with the compressed seal in place, may be readily handled for insertion in the disk, with a relatively loose fit, and accordingly, an easy insertion. The adhesive means selected should preferably be such that it burns off at a relatively low temperature, leaving no residue.

Figure 4:
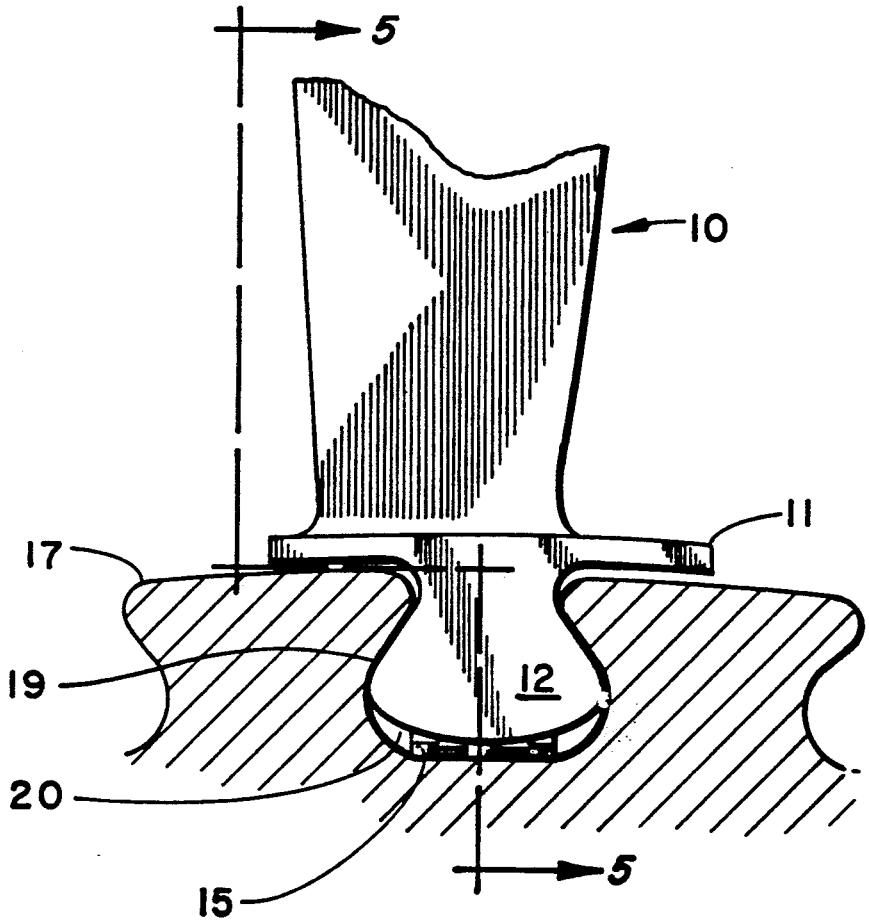
FIG. 4 is an end view of a rotor blade and sealing means mounted in a disk slot.

Shown in end view in FIG. 4, the blade root 12, inserted into receiving slot 19 in the disk 17, forms a cavity 20. The expandable graphite seal unit 15 of this invention is located within this cavity so as to prevent leakage of working gases upon expansion. In one alternative embodiment, the expandable graphite seal may be placed between the platform of the blade, 11, and the surface of disk 17, so as to provide a seal, and upon expansion provide a radially outwardly directed force against the blade. When utilized in this position (not illustrated), the expandable pre-compressed seal is preferably adhesively backed for attachment to the blade underside during assembly, and upon initial running of the engine expands to its full shape and properly seals the gap.

To eliminate an interference fit at assembly, it is desirable that the seal be held in a compressed state while the blade root 12 is inserted into the blade receiving slot 19 of the disk 17. This may be accomplished by compressing the seal means in the presence of a binder, and curing said binder so as to retain the state of compression in said seal. For example, a sheet of laminar exfoliated graphite may be infiltrated or impregnated by a liquid resin of suitable viscosity to achieve complete infiltration, and then compressed and cured under pressure, such as by means of heated platens. Thus, the resin binder may be cured in situ while the seal material is in a compressed state, resulting in a sheet material of lesser thickness upon release of pressure. Individual seal units may then be cut from said sheet. Alternatively, the heating and curing may be accomplished in a press mold configured so as to form individual seal units which may be chamfered if desired. In either case, one may prepare seal material of compressed laminar graphite, held in its compressed state by the presence of a cured or dried binder material. In still another alternative, the graphite seal material may be press molded to the final configuration desired, and then compressed and encapsulated in a suitable binder which is then cured to maintain the state of compression of the seal units.

In accordance with this invention, the binder selected should have adequate strength upon curing or drying to retain the state of compression of the seal units, and be such that they decompose or burn-off at relatively low temperatures, at least below the working temperatures of the disk and blade assembly in which said seal units are employed. Preferred binders are liquids of low viscosity, to achieve a complete infiltration of the laminar graphite seal material, and relatively low drying or curing temperatures. Suitable binders include such resinous materials as unfilled epoxy resins, urethanes, nylons, anaerobic sealants (e.g. Loctite ®, a product of Loctite Inc.), and slow setting superglues. The choice of a suitable resin is, of course, dependent upon a number of factors, such as processing parameters and degree of strength required for the purpose, and may be readily determined by one of ordinary skill.

A preferred resin for the present invention is Epon 828, an epoxy resin of Shell Chemicals Corporation, which cures at a suitably low temperature to a high strength, and will burn off at temperatures of from about 600° to 800° F. Inorganic binders may also be utilized in the present invention, such as sodium silicate or aluminum phosphate, which cure at relatively low temperatures and decompose at temperatures below about 800° F.

Figure 5:
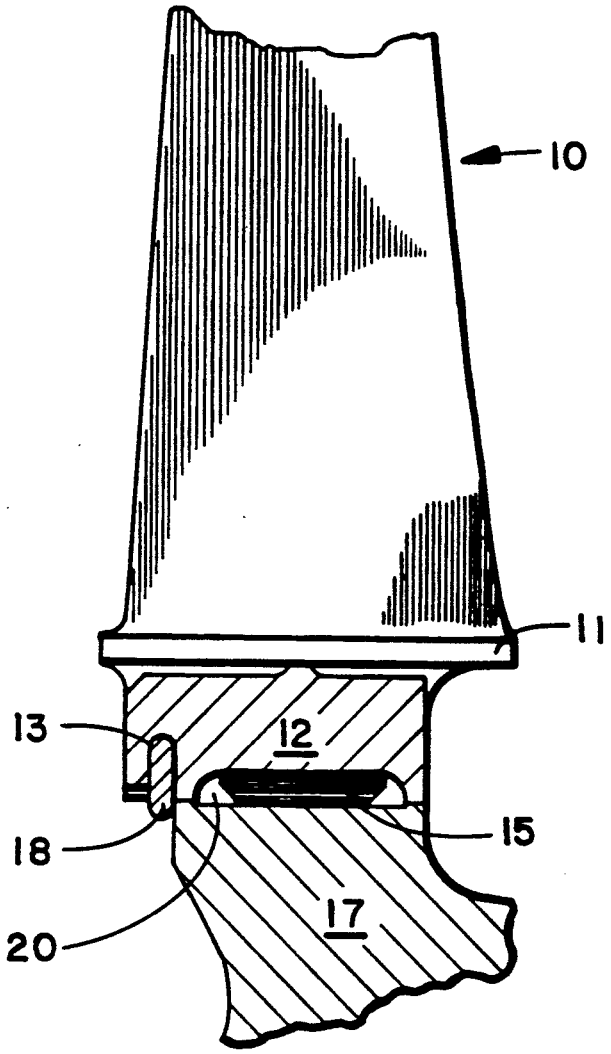
FIG. 5 is a cross section of a rotor blade and sealing means mounted in a disk slot, showing the position of the expanded seal of the present invention.

As shown in FIG. 5, a cross section taken at line 5—5 of FIG. 4, seal unit 15 is positioned between the blade root 12 of blade 10 and the disk 17, in the cavity 20 formed between said blade root and the slot in the disk. A locking pin or retaining ring 18 is shown in groove 13, but this is not a necessary part of the present invention.

Figure 6:
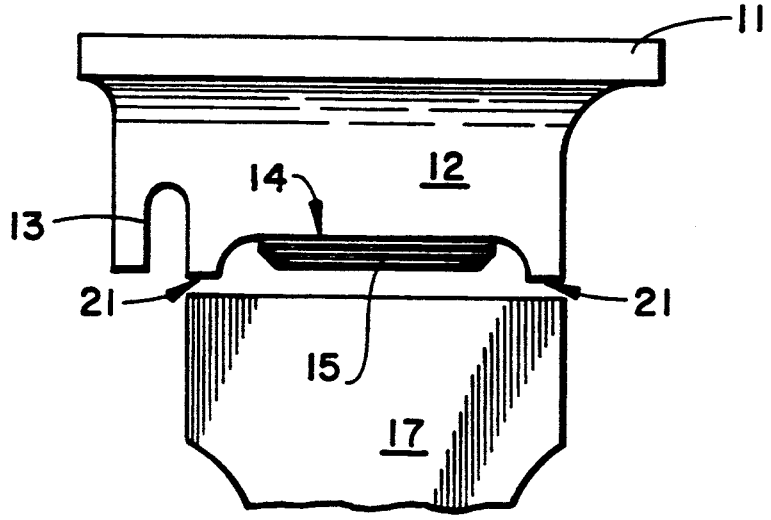
FIG. 6 shows an expandable seal which is pre-compressed at assembly, and held compressed by the resinous binder.
Figure 7:
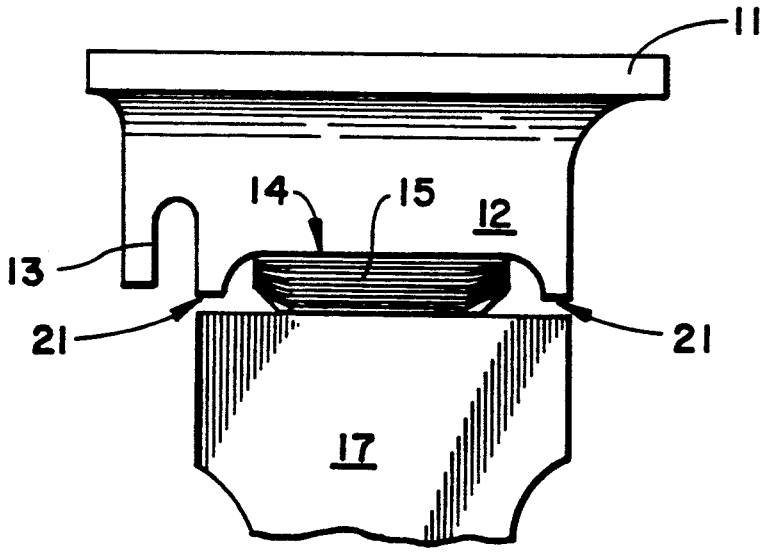
FIG. 7 illustrates an expandable seal which has expanded to seal the gap after temperature elevation has released the seal from the binder.

As previously indicated, it has been found beneficial to bevel or chamfer at least the leading edge of the laminar graphite seal material, relative to the direction of insertion into the blade root receiving slot of the disk. If the leading edge is not chamfered as indicated, that surface may be delaminated by the edge of the receiving slot when the blade root is inserted. When such delamination occurs, the seal is less effective and more subject to separation and leakage. However, it is to be noted that a principal advantage of the present invention is that compression of the seal unit 15 prevents such delamination. In its compressed state, as shown in FIG. 6, the seal unit does not extend beyond the height of the shoulder 21 of the blade root 12, and is thus protected during insertion of the blade root into slot 19. After insertion, the binder may be removed, preferably by thermal decomposition, although dissolution may also be utilized. Upon removal of the binder, the laminar graphite expands to its uncompressed dimensions, resulting in a tight fitting seal as illustrated in FIG. 7.

Expandable seals as set forth above are formed by impregnating a sheet of GRAFOIL ® laminated exfoliated flexible graphite with Epon 828 epoxy resin. The impregnated sheet is then placed in a heated press mold to simultaneously cure the resin and cut the sheet to provide a plurality of compressed seal units having the configuration shown in FIG. 2, having chamfered edges all around. These seals are bonded to axially slotted blades such as shown in FIG. 1, using Eastman 910 Adhesive, an acrylic based adhesive of Eastman Kodak Company, and the assemblies inserted into the receiving slots of the rotor disks of stages 6 and 7 of the high compressor of a gas turbine engine. Upon initial run-in and testing of the engine, the adhesive and the epoxy resin decompose, with the gaseous products of decomposition leaking away through the cavities. After decomposition of the resin, the laminar graphite sheet material expands to seal the cavity. The gas seals thus formed are found to withstand the operating temperatures of the compressor, and to provide a significant compressor efficiency benefit upon testing.

It is to be understood that the above description of the present invention is subject to considerable modification, change, and adaptation by those skilled in the art, and that such modifications, changes, and adaptations are to be considered to be within the scope of the present invention, which is set forth by the appended claims.

We claim:

1. In combination, a rotor disk having slots provided in the periphery thereof, rotor blades, said rotor blades having root portions shaped to fit the slots in the periphery of said disk, thereby creating cavities between said blade roots and said slots, and expandable sealing means adapted to fit within said cavities, said sealing means comprising laminar graphite material held in a compressed state by the presence of a binder material.

2. A combination as set forth in claim 1, wherein said sealing means are adapted to expand upon removal of said binder material.

3. A combination as set forth in claim 2, wherein said binder material is an organic resin.

4. A combination as set forth in claim 1, wherein said sealing means are adapted to prevent leakage of working gases between said blade roots and said slots.

5. A combination as set forth in claim 4, wherein said sealing means are formed by press-molding sheet material.

6. A combination as set forth in claim 5, wherein said sealing means are bonded to said blade root portions.

7. A combination as set forth in claim 1, wherein said sealing means are positioned between the disk and the underside of the blade platform.

* * * * *